US005318054A

United States Patent [19]

Neilson et al.

[11] Patent Number: 5,318,054

[45] Date of Patent: Jun. 7, 1994

[54] SPIRAL SPRING HAIR BARRETTE ASSEMBLY

[76] Inventors: Kris Neilson, 1819 Wall St., Everett, Wash. 98201; Terry Smith, 24223 Firdale Ave., Edmonds, Wash. 98020

[21] Appl. No.: 15,278

[22] Filed: Feb. 8, 1993

Related U.S. Application Data

[63] Continuation of Ser. No. 901,777, Jun. 22, 1992, abandoned.

[51] Int. Cl.[5] ..... H45D 8/34

[52] U.S. Cl. ..... 132/273; 132/275; 132/278

[58] Field of Search ..... 132/273, 275, 278

[56] References Cited

U.S. PATENT DOCUMENTS

| | | | |
|---|---|---|---|
| 971,519 | 10/1910 | Brannen | 132/273 |
| 1,725,125 | 8/1929 | Bartley | 132/273 |
| 2,407,393 | 9/1946 | Behr | 132/273 |
| 2,455,715 | 12/1948 | Webster | 132/273 |
| 2,805,673 | 9/1957 | Solomon | 132/275 |
| 2,924,228 | 2/1960 | McGee | 132/273 |
| 2,970,353 | 2/1961 | Stone | 132/273 |
| 3,471,867 | 10/1969 | Kirchhoff | 132/273 |
| 3,842,849 | 10/1974 | Goodman | 132/273 |
| 5,062,436 | 11/1991 | Emsellem | 132/275 |

*Primary Examiner*—Gene Mancene
*Assistant Examiner*—Frank A. LaViola
*Attorney, Agent, or Firm*—John S. Ferrell

[57] ABSTRACT

Disclosed is a spiral spring hair barrette assembly, useful for holding ponytails and other decorative hair configurations. The barrette consists of the combination of a comb and a flat spiral spring to which the comb is attached. The spiral spring has an inside and outside surface such that when the barrette spring is coiled, the inside surface coils around the ponytail being held. Projecting from the inside surface are combed teeth which also fix the barrette in place relative to the hair. The barrette is decoratively covered with fabric of various designs and materials.

14 Claims, 2 Drawing Sheets

SPIRAL SPRING HAIR BARRETTE ASSEMBLY

RELATED APPLICATIONS

This is a continuation of co-pending application Ser. No. 07/901,777 filed on Jun. 22, 1992 now abandoned.

BACKGROUND OF THE INVENTION

1. Field of the Invention

This invention relates to combs and hair care accessories and more particularly to a hair barrette assembly comprising a comb and a flat spiral spring, used for arranging, and designing hair settings.

2. Description of the Background Art

Archeologists have discovered hairpins, combs and hair ornaments dating back some 10,000 years. Records indicate that the ancient Egyptians, although often shaving their heads for relief from the sun; combed, weaved and curled wigs that were commonly worn and passed from generation to generation. For these thousands of years, combs have provided both utility and ornamentality in the arrangement and containment of hair settings. Historically combs of very intricate and artistic craftsmanship have been items treasured by various societies. These combs have been constructed of a variety of materials, both natural and synthetic.

SUMMARY OF THE INVENTION

In accordance with the present invention, a hair barrette is disclosed for combing and arranging hair and for holding the arrangement in place as a ponytail or other bundled configuration. The barrette consists of the combination of a comb and flat spiral spring to which the comb is attached. The barrette has an inside and outside surface such that when the barrette is coiled, the inside surface coils around the ponytail. Attached to the inside surface are combed teeth which also fix the barrette in place relative to the hair. The barrette is decoratively covered with fabric of various designs and material.

BRIEF DESCRIPTION OF THE DRAWINGS

FIG. 1(*b*) is a side view in portrait orientation of barrette 10 shown in relation to ponytail 16;

FIG. 3(*b*) is a side sectional view of the barrette of FIG. 3(*a*) showing decorative cover 24;

DESCRIPTION OF THE PREFERRED EMBODIMENT

Figure 1A:
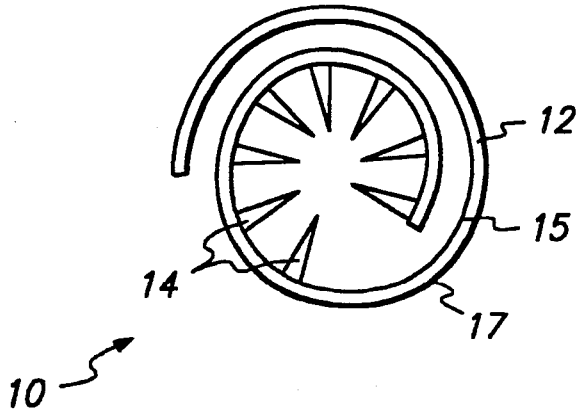
FIG. 1(*a*) is a side view in portrait orientation of a preferred embodiment of the present invention.
Figure 1B:
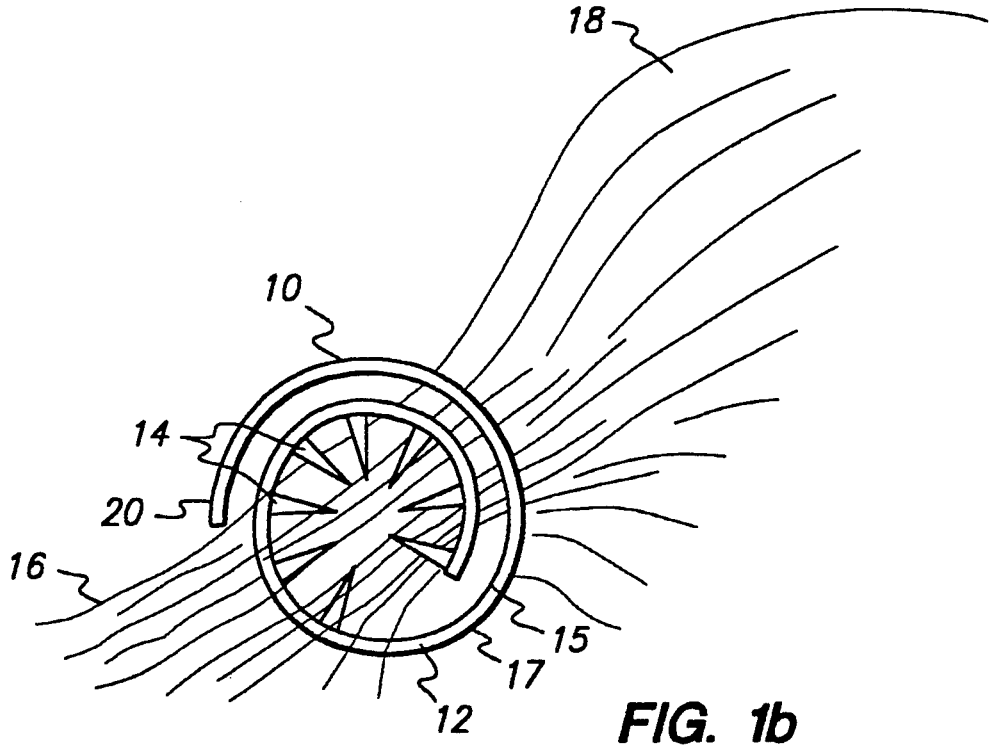

Referring now to FIG. 1(*a*), barrette 10 of the present invention is shown in side view, portrait orientation.

Barrette 10 consists of a flat spiral spring 12 having teeth 14 for grasping inwardly when barrette 10 is coiled, and for holding spring 12 in place. In a preferred embodiment, barrette 10 has an outside surface 17 and an inside surface 15, and teeth 14 are attached or project from the inside surface 15. Barrette 10 may be wound and used to hold hair in a ponytail or other decorative configuration. Spiral spring 12 is constructed of plastic, spring steel, stainless steel, or other similar material coiled to a preferred tension of three to eight pounds of constant force. The tension and size of the spring may be varied to hold different size ponytails.

The width of spring 12, although not critical to the functionality of the disclosed apparatus, may be varied to produce different cosmetic and ornamental effects when worn in the hair. For example, a pair of tightly wound barrettes 10 constructed of ½ inch wide springs 12 might be used in combination to form a pair of ponytails, or a single such barrette 10 would be used for a child's hair. On the other hand, a larger 2 inch wide barrette 10 might be brightly decorated and used to fashionably hold a waist length ponytail worn by a tall woman.

Referring now to FIG. 1(*b*), barrette 10 is shown wrapped around ponytail 16. Barrette 10 is shown having an end 20 which acts as a trailing edge of the spiral barrette 10. Teeth 14 are used to hold hair 18 into the ponytail 16 configuration. In general, barrette 10 is worn as close to the base of hair 18 as possible. Although ponytail 16 of FIG. 1(*b*) is shown with only a single barrette 10 in place, it may be desirable to wear two or more such barrettes simultaneously on the same ponytail for ornamental effect.

Figure 2:
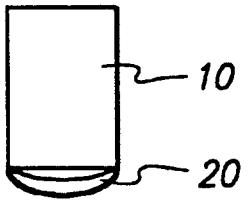
FIG. 2 is a front view of barrette 10 in portrait orientation showing end 20.

Referring now to FIG. 2, barrette 10 is shown in edge view with end 20 visible. The preferred embodiment of barrette 10 shown, has a width of 1 inch and a coiled diameter of 2 inches or less. Spring 12 of barrette 10 is coiled into a spiral disposition between 1 and 2 revolutions.

Figure 3A:
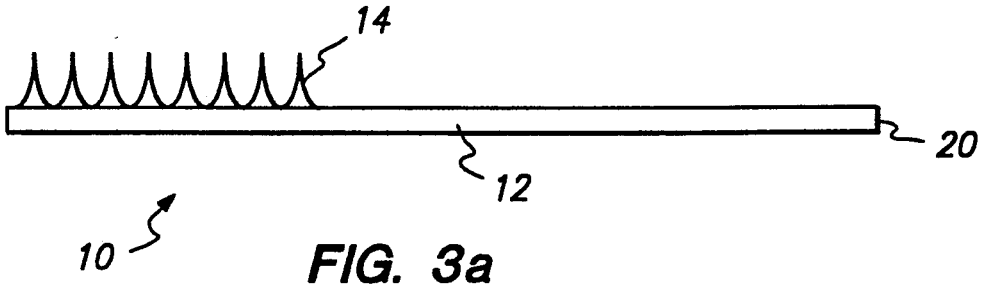
FIG. 3(*a*) is a side view in portrait orientation of a preferred embodiment of barrette 10 with spring 12 extended.
Figure 3B:
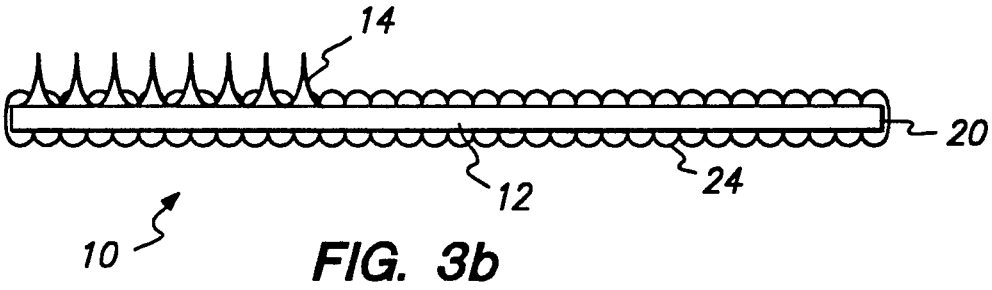

Referring now to FIG. 3(*a*), a side view in portrait orientation of barrette 10 is shown, with spring 12 extended in a flat disposition. Teeth 14 are shown extending from one end of barrette 10, opposite end 20. Seven teeth 14 are used in the preferred embodiment, each spaced approximately ⅜ inches apart. Alternative embodiments of the present invention utilize combs having more or less teeth of varied spacings. The length of spring 12 is approximately 9 inches. None of the dimensions recited are critical to the utility of this apparatus.

Referring now to FIG. 3(*b*), barrette 10 of FIG. 3(*a*) is shown further comprising cover 24 which is wrapped about spring 12. This cover preferably is made of decorative material such as cloth, silk, neoprene, or plastic, and functions to esthetically enhance the use of barrette 10. Cover 24 can be applied by gluing, sewing or other attachment means about spring 12 and can be grouped or pleated to provide additional flexibility and ornamentality. In a preferred embodiment, cover 24 is constructed by forming a loose fitting "sock", sewn at both ends, into which the spring 12 and teeth 14 combination is inserted. Cover 24 is pleated along the length of spring 12 to allow flexibility during coiling. Various fabric colors can be used to highlight and complement the hair style and wardrobe of the user.

Figure 4:
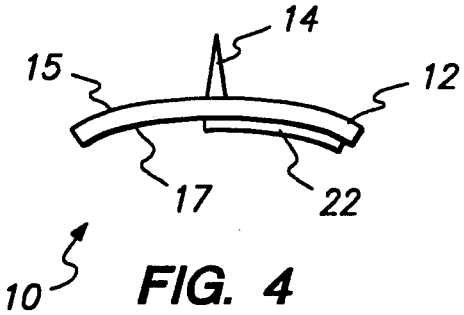
FIG. 4 is a front edge view in portrait orientation of a preferred embodiment of barrette 10 showing the base of comb 22 attached to outside surface 17 of spring 12 with teeth 14 extending through spring 12 and extending from inside surface 15.

Referring now to FIG. 4, a front edge view of extended barrette 10 is shown in portrait orientation. Teeth 14 are shown protruding through spring 12 and having a base 22 attached to the underside or outside surface 17 of spring 12. Teeth 14 may be manufactured at right angles to base 22 to provide additional support for the teeth 14. Base 22 is preferably constructed of an elastic or flexible material. One method of preparing the combination of teeth 14 and base 22 for installation on spring 12 is to apply a hot knife or other flat instrument to the base of a flexible plastic hair comb and bending the comb teeth perpendicular to the base. Glue or epoxy is used to attach base 22 to outside surface 17 of spring 12.

Figure 5:
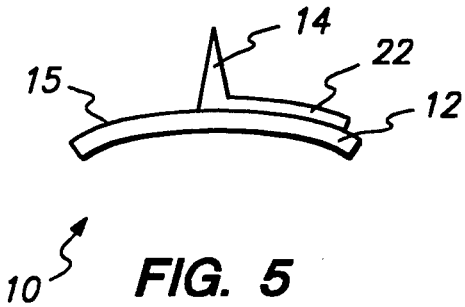
FIG. 5 is an alternative embodiment of barrette 10 in portrait orientation showing both base 22 and teeth 14 connected to and extending from inside surface 15.

Referring now to FIG. 5, an alternative embodiment is shown in which base 22 is attached to the inside surface 15 of spring 12 and teeth 14 are again extending perpendicular to base 22. As in the embodiment of FIG. 4, glue or epoxy can be used to attach base 22 to spring 12.

Figure 6:
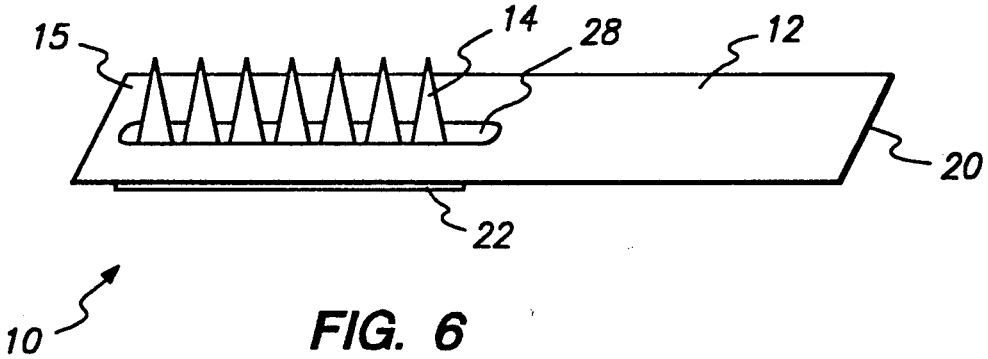
FIG. 6 is a top perspective view of the preferred embodiment shown in FIG. 4.

Referring now to FIG. 6, the preferred embodiment of FIG. 4 is shown in top perspective view. Base 22 is shown attached to the outside surface 17, with teeth 14 projecting through slot 28 of spring 12. The purpose of slot 28 is to allow longitudinal movement (along the length of spring 12) of teeth 14 as spring 12 is coiled during use.

The invention has now been explained with reference to specific embodiments. Other embodiments will be apparent to those of ordinary skill in the art in light of this disclosure. For example, in light of the embodiments described, it would be obvious to construct spring 12 and teeth 14 as a single unit molded of plastic, metal or similar material. In this alternative embodiment, teeth 14 would be integrally formed or connected to the spring without the use of base 22. For instance, spring 12 would be constructed of molded plastic with teeth 14 molded at the time spring 12 is formed. Alternatively, spring 12 could be constructed of metal and teeth 14 could be soldered, welded or otherwise bonded individually to spring 12. Therefore it is not intended that this invention be limited, except as indicated by the appended claims.

We claim:

1. A spiral spring hair barrette assembly for holding hair in a ponytail comprising:

coil spring means for coiling about the ponytail, the spring means having a first end and a second end, wherein the first end acts as a trailing edge for holding the coil tightly in a spiral configuration; and means attached proximate only the second end of the coil spring means for grasping the hair and holding the coil spring means in place.

2. The spiral spring hair barrette assembly of claim 1 wherein the coil spring means is constructed of spring steel.

3. The spiral spring hair barrette assembly of claim 1 wherein the coil spring means is constructed of plastic.

4. The spiral spring hair barrette assembly of claim 1 wherein the coil spring means has an inside surface and an oppositely situated outside surface, and wherein the inside surface coils inwardly.

5. The spiral spring hair barrette assembly of claim 1 wherein the means for grasping the hair comprises a set of teeth projecting inwardly into the coil from the inside surface.

6. The spiral spring hair barrette assembly of claim 5 wherein the teeth are constructed of plastic.

7. The spiral spring hair barrette assembly of claim 5 wherein the teeth are attached to a perpendicular base.

8. The spiral spring hair barrette assembly of claim 7 wherein the base is attached to the outside surface of the coil spring means and the teeth project inwardly through a longitudinal slot in the coil spring means.

9. The spiral spring hair barrette assembly of claim 8 wherein the base is attached to the outside surface by glue.

10. The spiral spring hair barrette assembly of claim 7 wherein the base is attached to the inside surface of the coil spring means and the teeth project inwardly from the inside surface.

11. The spiral spring hair barrette assembly of claim 10 wherein the base is attached to the inside surface by glue.

12. The spiral spring hair barrette assembly of claim 1 further comprising a decorative cover that ensheaths the coil spring means.

13. The spiral spring hair barrette assembly of claim 12 wherein the cover is constructed of fabric.

14. The spiral spring hair barrette assembly of claim 12 wherein the cover is constructed with pleats to allow coiling of the cover with the coil spring means.

* * * * *